United States Patent [19]

Kendall

[11] 4,243,226

[45] Jan. 6, 1981

[54] CARD GAME

[76] Inventor: Roy E. Kendall, Flat 4, 20 Crookham Rd., Fulham, London SW6, England

[21] Appl. No.: 19,341

[22] Filed: Mar. 12, 1979

[51] Int. Cl.[3] ..... A63F 1/00

[52] U.S. Cl. ..... 273/292; 273/308

[58] Field of Search ..... 273/292, 303, 304, 305, 273/306, 308

[56] References Cited

U.S. PATENT DOCUMENTS 178,863 6/1876 Levy ..... 273/303

1,117,316 11/1914 Booton et al. ..... 273/306

1,139,356 5/1915 Fields ..... 273/306 X

*Primary Examiner*—Anton O. Oechsle

*Attorney, Agent, or Firm*—Emory L. Groff, Jr.

[57] ABSTRACT

A card game has 15 numbered cards in one suit, 22 numbered cards in a second suit and 23 numbered cards in a third suit. Three further and different 'wild' cards are included in the game. The suits are represented by symbols indicating FIRE, WATER and EARTH while the wild cards are represented by MAN, APE and AIR devices respectively.

1 Claim, 6 Drawing Figures

CARD GAME

BACKGROUND OF THE INVENTION

This invention relates to a card game.

It is an object of this invention to provide a card game for amusement and enjoyment, wherein the winner is the player first achieving a total of 100 points in a series of hands or generations.

SUMMARY OF THE INVENTION

According to this invention there is provided a card game of 63 cards comprising a first suit of 15 numbered cards each of which carries a first distinguishing feature, a second suit of 22 numbered cards each of which carries a second distinguishing feature, a third suit of 23 numbered cards each of which carries a third distinguishing feature and 3 individual wild cards each of which carries a further and different distinguishing feature.

BRIEF DESCRIPTION OF THE DRAWINGS

In order that the invention may be readily carried into effect, it will now be described with reference to the accompanying drawings, wherein.

DETAILED DESCRIPTION OF PREFERRED EMBODIMENT

Figure 1:
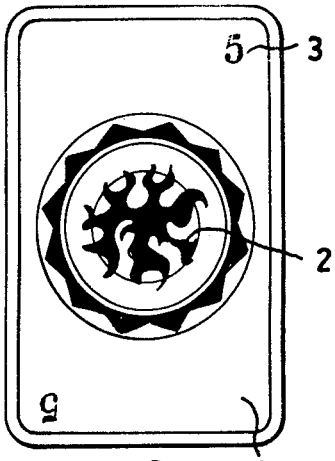
FIG. 1 is a view of a FIRE card of the game according to the invention.
Figure 2:
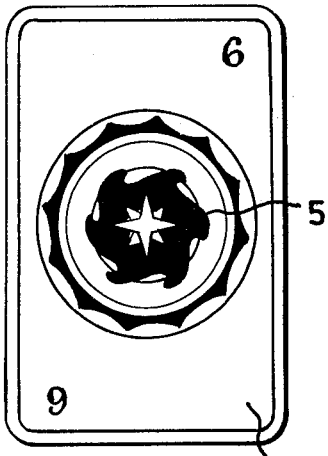
FIG. 2 is a side view of a WATER card of the game according to the invention.
Figure 3:
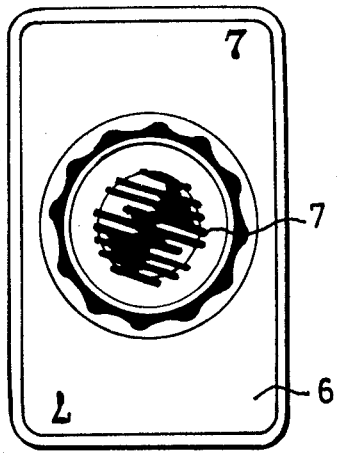
FIG. 3 is a view of an EARTH card of the game according to the invention.
Figure 4:
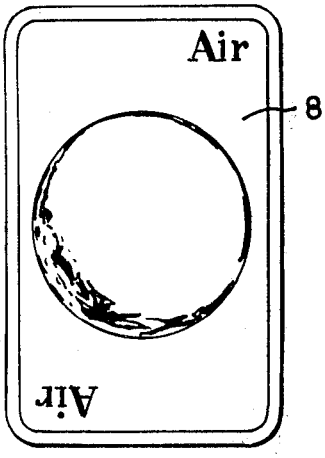
FIG. 4 is a view of the AIR card of the game according to the invention.
Figure 5:
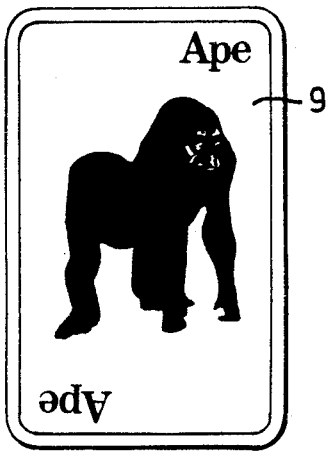
FIG. 5 is a view of the APE card of the game according to the invention and FIG. 6 is a view of the MAN card of the game according to the invention.
Figure 6:
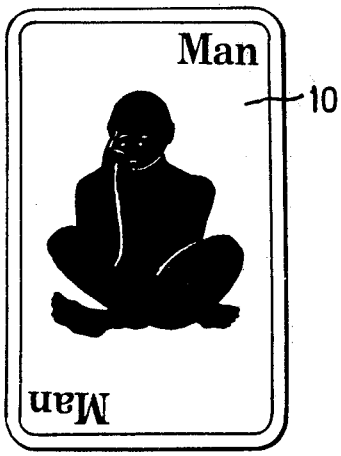

The game of the invention comprises 15 cards 1 in a FIRE suit represented by a fire symbol 2 and carrying a numeral 3, shown in FIG. 1. A WATER suit of 23 cards 4 including a water symbol 5 is illustrated in FIG. 2. FIG. 3 shows an EARTH card 6 carrying earth symbol 7, in which suit 22 such cards are provided. The remaining 'wild' cards are shown by the AIR card 8 of FIG. 4, the APE card 9 of FIG. 5 and the MAN card 10 of FIG. 6 respectively.

THE OBJECT

To be first to achieve a total of 100 points in a series of hands or 'generations'—thus winning the game.

Should two or more players break 100 points in the same generation, the winner is the one with the highest score. Should there be a tie, the winner is the player who had the lowest score before that generation. A Match is won by the first player to win two games.

THE PACK

The pack consists of three suits; red cards (FIRE), brown cards (EARTH) and blue cards (WATER).

The FIRE suit is numbered from 1 to 15 and contains only one of each card.

The EARTH suit is also numbered from 1 to 15 but every even numbered card is double up. Thus there are two 2s, two 4s, two 6s, etc.

The WATER suit, also similarly numbered, has all its odd numbered cards doubled up. So it has two 1s, two 3s, two 5s etc.

There are, therefore, 15 red, 22 brown and 23 blue cards in the packs.

In addition to these, there are three wild cards; the 'MAN' card, the 'APE' card and the 'AIR' card.

The MAN card may be used as any colour or number from 1 to 15.

The APE card may be used as any colour, but only as a 16.

The AIR card can be used as any colour, but only as a nought/zero card.

SCORING

Points may be scored in tricks of any number of cards from three to nine, but can only be scored in tricks of three, four, five, six and nine cards, when a player goes 'out'.

Each trick must satisfy the following NUMERICAL and COLOUR combination requirements.

NUMERICAL

There must be an equal number between each of the cards in the trick. This means that a three card trick could only be made up of cards numbered say, 2–4–6–, 2–6–10, 5–8–11, 2–9–APE (16).

In each case, the first card subtracted from the second card, equals the same figure as the second card subtracted from the third.

Points are scored by multiplying this figure—the difference—by the number of cards in the trick.

Thus the trick of 2–4–6 or AIR (0)–2–4 scores 6 points (2 from 4=2; 4 from 6=2); so 2 (the difference) multiplied by 3 (the number of cards in the trick)=6; the trick of 2–6–10 scores 12 points; the trick of 5–8–11 scores 9 points and the trick of 2–9–APE scores 21 points. Therefore the larger the gap, the higher the score. The same applies to tricks of more than three cards.

EXAMPLES (a) A four card trick
12 points are scored for the cards 6–9–12–15; 3 (the difference) multiplied by four (the number of cards)=12.

(b) A five card trick
15 points for 1–4–7–10–13 ($3\times5=15$)

(c) A six card trick 12 points for 3–5–7–9–11–13 ($2\times6=12$)

(d) A nine card trick
9 points for 6–7–8–9–10–11–12–13–($1\times9=9$)

However, in the case of a nine card trick, the player actually achieving this, is awarded an extra 40 points for using all his/her nine cards in one trick. Thus a nine card trick scores 49 points.

Should a player get out using only two tricks (i.e. a hand with a trick of three cards and a trick of six cards or a hand with a trick of four cards and a trick of five cards) this player is awarded 20 points in addition to those scored by the cards.

No extra points are awarded for a hand of three tricks of three cards.

COLOUR COMBINATIONS

As well as having equidistant numbering, tricks (of any number of cards) must also satisfy the following colour requirements, and only count (a) if all cards of the trick are of the same colour.

(b) if a combination of any two colours alternates throughout the trick.

Examples of tricks in category (b) are: 5 (RED) 9 (BLUE) 13 (RED); 5 (BLUE) 9 (RED) 13 (BLUE); 2 (BROWN) 8 (BLUE) 14 (BROWN); 7 (BLUE) 8 (BROWN) 9 (BLUE) 10 (BROWN); 3 (RED) 6 (BROWN) 9 (RED) Man (acting as a BROWN 12) 15 (RED).

But the four cards 2 (RED) 4 (RED) 6 (BROWN) 8 (BROWN) would not count as a trick, even though they satisfy the numerical requirements., nor would the three cards 2 (BROWN) 4 (BLUE) 6 (RED) count and therefore would not score.

FIRE CARDS

A trick made up of entirely red FIRE cards (and which does not use the Air, Man or the Ape card) counts double. However, FIRE cards in a player's hand, but not in a trick when a generation is concluded, count double against the player holding them.

WILD CARDS

Wild cards not in tricks, count high against the player holding them at the conclusion of a generation.

METHOD OF PLAY

The dealer is chosen by players 'cutting the pack'. The player with the highest numbered card deals.

The dealer shuffles the pack and clockwise, deals six cards face downwards, to each player.

Then he/she deals each player with three more cards, but separate from the other six.

The dealer then places the pack, face downwards, on the table and turns up the top two cards, placing them face upwards, one on either side of the pack. (For the sake of clarity, these will be referred to here as sides X and Y). Players then pick up the first six cards dealt (leaving the 'special' three, face down on the table) and play begins.

OPENING ROUNDS

The player on the dealer's left starts, by choosing and picking up a card from side X or side Y or by taking a card 'blind' from the top of the pack.

This done, the player must throw away a card.

Players can discard on to either side X or side Y, but there must always be a card on both sides for the following player to chose from.

Play then moves clockwise, to the player on the first player's left, who picks up, as above and throws away.

If there are three or four players, play proceeds in similar fashion, each player trying to arrange his/her cards into tricks, until one round has been completed and each player has picked up and thrown away.

The dealer then turns over the top card of his special three cards, so that it is visible to all players and asks the other players to do likewise.

A second round is then played.

At the end of this, each player turns over the second card of the three—the third still remaining face downwards.

Play then goes into a third round.

At no point during the first three rounds must a player miss a turn.

Every player must pick up and put down; if a player picks up a card from either side X or side Y, the player must not throw away that card, (nor a card of the same numbering and colour) during that round.

END PLAY

When three rounds have been completed, players must put their cards face downwards on the table.

Each player now picks up the three cards that have been dealt separately, not showing the other players the third card, which has remained face downwards. The dealer then asks if any player wishes to declare; for a player may be able to form the three special cards and the six on the table into tricks; but a player may not look at the six cards to do so. If there is no declaration at this point, no player may declare until it is his/her turn to play. If a player declares, this ends the generation and the player must then show all his/her cards and add up their score.

Should the player's cards not all form 'true' tricks the player loses 15 points for a false declaration. (This also applies at any subsequent stage of the game.)

Should a player go out, the other players must then make the best score they can with what cards they have in their hands and on the table.

This is done by counting the score of the trick/tricks they have and subtracting the total value of all cards not in tricks, from this, (remembering that any red card not in a trick, will cound double its value against whoever is holding it), or by re-arranging their cards in order to get as many cards as possible, (particularly high numbered, wild and red cards) into tricks. If a player cannot form a trick, all cards count against him.

Each person's total is written down on a piece of paper and the deal then moves to a player on the dealer's left, who shuffles and begins a new generation, proceeding as above. It should be pointed out that minus scores are not uncommon, particularly during the early stages of the game. But a lower limit of minus 50 points is set and any player losing more points remains at that score.

If there is no declaration, players then take up their six cards and play continues, starting with the player on the dealer's left, in the same manner as in the Opening Rounds, except that each player now has nine cards.

When a player finds The Missing Link, i.e. the card that finally links all cards in his hand into tricks, the player may declare, though only when it is his/her turn.

In this event, scoring again proceeds as described earlier; the players' scores are written down and the next generation commences.

In the unusual event of no player declaring before the last remaining face downward card is turned up, the two piles of cards on sides X and Y must be shuffled together by the dealer, the pack placed face downwards again and the top two cards turned up, before play may continue.

I claim:

1. A card game comprising a first suit of 15 cards numbered from 1 to 15 and each of which carries a fist distinguishing feature, a second suit of 22 cards numbered from 1 to 15 and containing two of every even numbered card, each card in said second suit carrying a second distinguishing feature, a third suit of 23 cards numbered from 1 to 15 and containing two of every odd numbered card, each card in said third suit carrying a third distinguishing feature and 3 individual wild cards each of which carries a further and different distinguishing feature.

* * * * *